US008596244B2

(12) United States Patent
Thomas et al.

(10) Patent No.: US 8,596,244 B2
(45) Date of Patent: Dec. 3, 2013

(54) AUTOMOTIVE VEHICLE THROTTLE VALVE DISPLAY SYSTEM AND METHOD OF USE THEREOF

(75) Inventors: Freeman Thomas, Laguna Beach, CA (US); Mark Gorman, Valencia, CA (US); Sven Etzelsberger, Huntington Beach, CA (US)

(73) Assignee: Ford Global Technologies, LLC, Dearborn, MI (US)

( * ) Notice: Subject to any disclaimer, the term of this patent is extended or adjusted under 35 U.S.C. 154(b) by 1409 days.

(21) Appl. No.: 11/620,199

(22) Filed: Jan. 5, 2007

(65) Prior Publication Data

US 2008/0163849 A1 Jul. 10, 2008

(51) Int. Cl.
*F02D 11/02* (2006.01)

(52) U.S. Cl.
USPC ..... 123/399; 123/395

(58) Field of Classification Search
USPC ..... 123/184.56, 559.1, 470, 198 E, 184.21, 123/566, 399, 361, 352; 180/69.24; 55/342
See application file for complete search history.

(56) References Cited

U.S. PATENT DOCUMENTS

| | | | | |
|---|---|---|---|---|
| 3,757,751 | A * | 9/1973 | Kitchin et al. | 123/566 |
| 4,919,096 | A * | 4/1990 | Manaka et al. | 123/399 |
| 6,463,901 | B1 * | 10/2002 | Cuddihee et al. | 123/184.21 |
| 7,281,511 | B2 * | 10/2007 | Quezada | 123/184.53 |
| 2005/0045139 | A1 * | 3/2005 | Fagala | 123/184.56 |

* cited by examiner

*Primary Examiner* — Lindsay Low
(74) *Attorney, Agent, or Firm* — Frank A. MacKenzie; Brooks Kushman P.C.

(57) ABSTRACT

A display system for an automotive vehicle indicates the position of a throttle valve.

7 Claims, 3 Drawing Sheets

AUTOMOTIVE VEHICLE THROTTLE VALVE DISPLAY SYSTEM AND METHOD OF USE THEREOF

BACKGROUND OF THE INVENTION

1. Field of the Invention

The invention relates to automotive vehicle throttle valve display systems and methods of use thereof.

2. Discussion

A vehicle may include an engine operatively connected with at least one wheel to drive the wheel and thus move the vehicle. Engine performance may affect vehicle handling and driveability. Several factors may influence engine performance. Air flow to the engine may be one of these factors.

A throttle valve of an engine may regulate the amount of air entering the engine. As a gas pedal is depressed, the throttle valve opens and allows an increased amount of air to flow to the engine. An engine control unit may respond to this open throttle valve position by increasing the fuel rate.

A driver may not view the throttle valve during vehicle operation from the cabin of the vehicle.

SUMMARY

Embodiments of the invention may take the form of a throttle valve display system for an automotive vehicle. The vehicle includes a throttle valve having a throttle valve position, a gas pedal having a gas pedal position, and an exterior. The gas pedal position is related to the throttle valve position. The system includes a sensor arrangement configured to sense the gas pedal position and a controller in communication with the sensor arrangement. The system also includes a throttle valve display device for indicating the throttle valve position. The device is mounted to the exterior of the vehicle and includes a flapper panel operatively connected with the controller. The controller is configured to move the flapper panel to a predetermined position based on the gas pedal position thereby indicating the throttle valve position.

Embodiments of the invention may take the form of a method for indicating a throttle valve position of a throttle valve of an automotive vehicle without measuring the throttle valve position. The vehicle includes a gas pedal having a gas pedal position. The gas pedal position is related to the throttle valve position. The method includes providing a sensor arrangement configured to sense the gas pedal position and providing a controller in communication with the sensor arrangement. The method also includes providing a throttle valve display device for indicating the throttle valve position. The device is mounted to the exterior of the vehicle and includes a flapper panel operatively connected with the controller. The method further includes moving the flapper panel to a predetermined position based on the gas pedal position thereby indicating the throttle valve position.

While exemplary embodiments in accordance with the invention are illustrated and disclosed, such disclosure should not be construed to limit the claims. It is anticipated that various modifications and alternative designs may be made without departing from the scope of the invention.

DETAILED DESCRIPTION

Feedback on engine performance parameters may be important for optimum vehicle use. The amount of air an engine receives may be an engine performance factor. A driver may desire to have a visual indication of the amount of air the engine is receiving.

Figure 1:
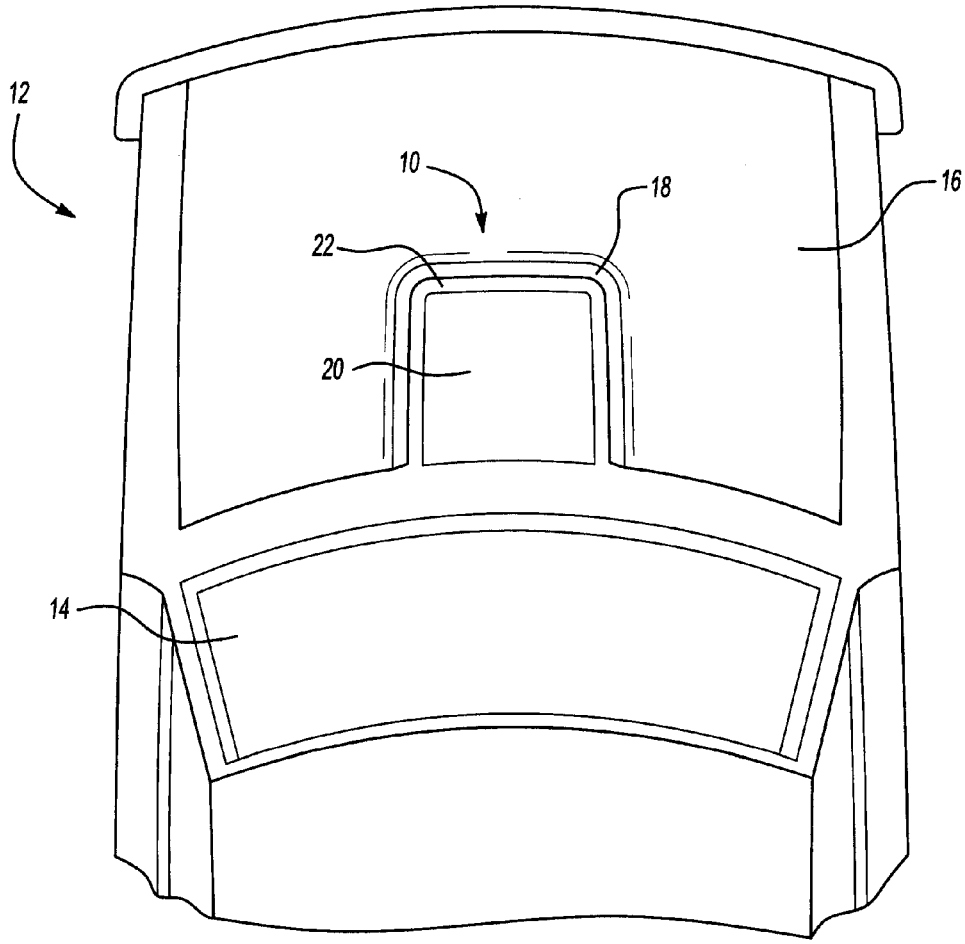
FIG. 1 is a plan view of an automotive vehicle including a throttle valve display system in accordance with an embodiment of the invention and shows the location of the throttle valve display system.

FIG. 1 is a plan view of throttle valve display system 10 of vehicle 12. In alternative embodiments, display system 10 may be located elsewhere. As will be explained below, display system 10 indicates a position of throttle valve 32 (FIG. 4) of the engine (not shown).

Vehicle 12 includes cabin 14 and hood 16. Hood 16 includes chamfered area 18. Display system 10 includes shaker hood 20 and is mounted, e.g., bolted, with the engine. Gap 22 lies between shaker hood 20 and hood 16. As such, display system 10 is isolated from hood 16.

Figure 2A:
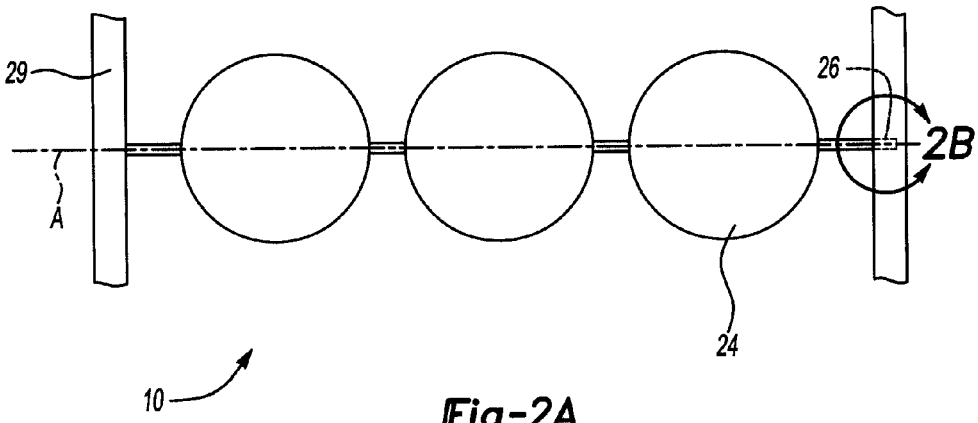
FIG. 2A is an end elevation view of a portion of a throttle valve display system for an automotive vehicle in accordance with an embodiment of the invention and shows a butterfly panel which can rotate about a member.

FIG. 2A is an end elevation view of a portion of display system 10. Display system 10 includes butterfly panel 24 which moves about axis A of member 26, e.g., metal rod.

Figure 2B:
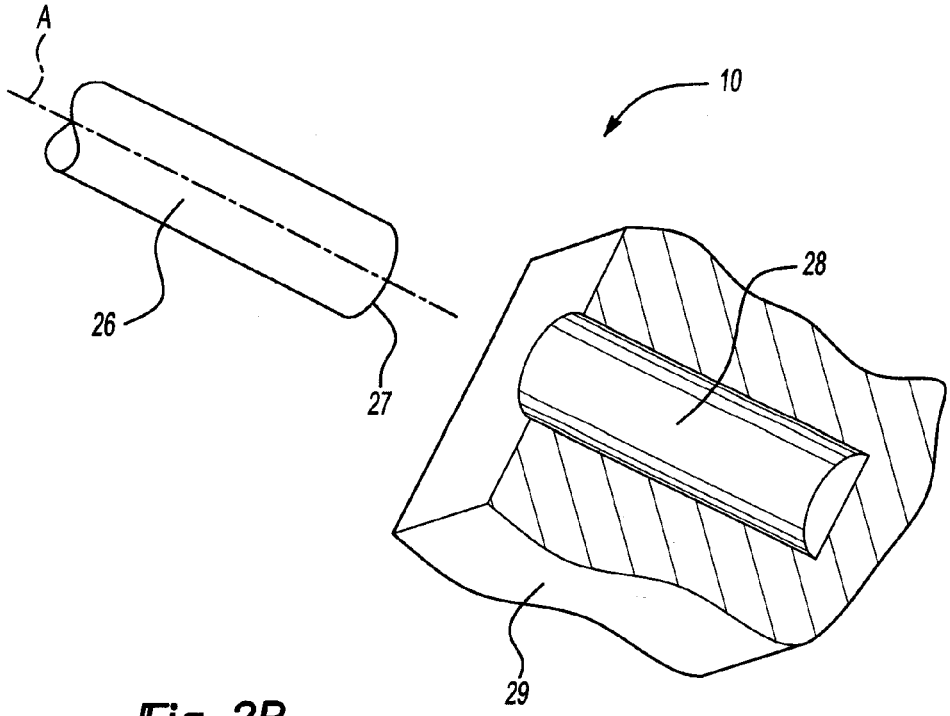
FIG. 2B is an exploded view of a portion of a member and support wall of a throttle valve display system in accordance with an embodiment of the invention.

FIG. 2B is an exploded view of a portion of member 26 and support wall 29 of display system 10. Member 26 includes end portions 27 which are configured to be received by slots 28 of support wall 29. If inserted into slots 28, rotating member 26 is free to rotate about axis A. Slots 28 may be sized such that, for example, bearings or bushings may be included to facilitate the movement of member 26 about axis A.

In alternative embodiments, butterfly panel 24 may be hingedly fixed with member 26. In these embodiments, member 26 does not rotate. Rather, butterfly panel 24 moves relative to member 26 via hinges.

Figure 3:
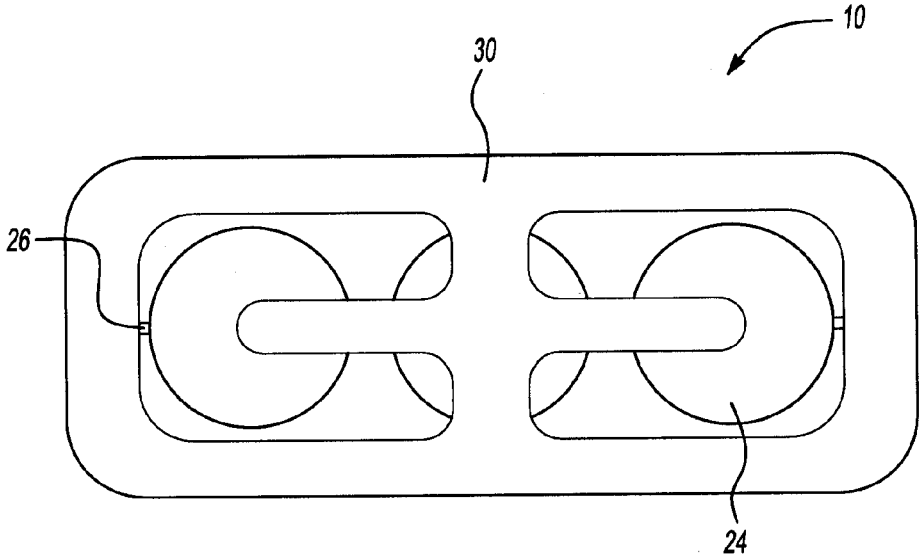
FIG. 3 is another end elevation view of a throttle valve display system in accordance with an embodiment of the invention and shows a facia panel that partially conceals at least a portion of a butterfly panel from occupant view.

FIG. 3 is an end elevation view of display system 10 including facia panel 30. Facia panel 30 conceals at least a portion of butterfly panel 24 from occupant view from cabin 14 (FIG. 1).

Figure 4:
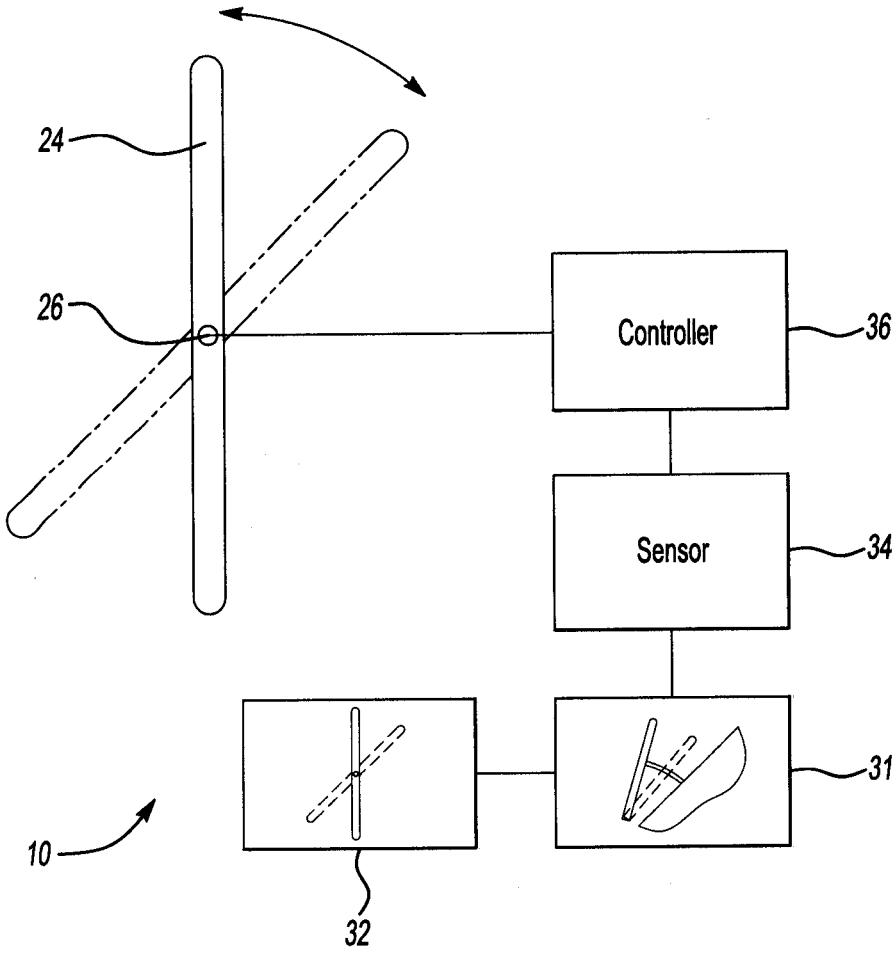
FIG. 4 is a side elevation view of a butterfly panel and its associated control arrangement, in block diagram format, in accordance with an embodiment of the invention.

FIG. 4 is a side elevation view of butterfly panel 24 and its associated control arrangement in block diagram format. The control arrangement is configured to move butterfly panel 24 as will be described below.

Vehicle 12 further includes gas pedal 31 and throttle valve 32. Gas pedal 31 and throttle valve 32 are operatively connected, in conventional fashion, e.g., via cable or other mechanical linkage, such that a position of gas pedal 31 is related to a position of throttle valve 32. If gas pedal 31 is not actuated (as shown in solid line), throttle valve 32 is closed (as shown in solid line), and if gas pedal 31 is fully actuated (as shown in phantom line), throttle valve 32 is fully opened (also shown in phantom line). Gas pedal 31 may achieve positions between not actuated and fully actuated. Likewise, throttle valve 32 may achieve corresponding positions between closed and fully opened.

Gas pedal sensor 34 is configured to sense a position of gas pedal 31 in a conventional manner. Gas pedal sensor 34 communicates with controller 36, via, for example, a car area network or direct hard-wire link. Controller 36, e.g., processors and associated control motors mechanically connected with butterfly panel 24, interprets information from gas pedal sensor 34 and moves butterfly panel 24 accordingly. For example, if gas pedal 31 is not actuated (as shown in solid line), butterfly panel 24 is in the upright or closed position (as shown in solid line). If gas pedal 31 is fully actuated (as shown in phantom line), butterfly panel 24 will be in the open position (as shown in phantom line). Similarly, positions of gas pedal 31 between the unactuated and fully actuated positions correspond to positions of butterfly panel 24 between the closed and fully opened positions. As such, display system 10 indicates the position of throttle valve 32.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A throttle valve display system for an automotive vehicle including a throttle valve having a throttle valve position, a gas pedal having a gas pedal position, and an exterior, the gas pedal position being related to the throttle valve position, the system comprising:

a sensor arrangement configured to sense the gas pedal position;

a controller in communication with the sensor arrangement; and a throttle valve display device for indicating the throttle valve position, the device being mounted to the exterior of the vehicle and including a flapper panel operatively connected with the controller, the controller being configured to move the flapper panel to a predetermined position based on the gas pedal position thereby indicating the throttle valve position.

2. The system of claim 1 wherein the flapper panel further includes an axis and wherein the flapper panel is configured to rotate about the axis.

3. The system of claim 1 wherein the gas pedal is moveable between first and second positions, wherein the flapper panel is moveable between closed and open positions, wherein the flapper panel is in the closed position if the gas pedal is in the first position and wherein the flapper panel is in the open position if the gas pedal is in the second position.

4. The system of claim 1 further comprising a body panel configured to shield a portion of the throttle valve display device.

5. The system of claim 4 wherein the body panel comprises a shaker hood.

6. The system of claim 1 wherein the vehicle includes a cabin and wherein a portion of the flapper panel is visible from the cabin.

7. A throttle valve display system for an automotive vehicle including a throttle valve and a gas pedal, the system comprising:

a sensor arrangement configured to sense a position of the gas pedal;

a controller in communication with the sensor arrangement; and a throttle valve display device mounted to an exterior of the vehicle and fluidly separated from the throttle valve, the device including a flapper panel operatively connected with the controller, the controller being configured to move the flapper panel to a predetermined position based on the position of the gas pedal to indicate a position of the throttle valve.

* * * * *